US011015816B2

(12) United States Patent
Lee

(10) Patent No.: US 11,015,816 B2
(45) Date of Patent: May 25, 2021

(54) DOOR HANDLE

(71) Applicant: SEO WON KOREA CO., LTD., Gimhae-si (KR)

(72) Inventor: Juneyoung Lee, Gimhae-si (KR)

(73) Assignee: SEO WON KOREA CO., LTD.

( * ) Notice: Subject to any disclaimer, the term of this patent is extended or adjusted under 35 U.S.C. 154(b) by 121 days.

(21) Appl. No.: 16/002,154

(22) Filed: Jun. 7, 2018

(65) Prior Publication Data

US 2018/0283698 A1 Oct. 4, 2018

Related U.S. Application Data

(63) Continuation of application No. PCT/KR2016/012573, filed on Nov. 3, 2016.

(30) Foreign Application Priority Data

Dec. 8, 2015 (KR) ..... 10-2015-0173775

(51) Int. Cl.
*F24C 15/02* (2006.01)
*E05B 7/00* (2006.01)
*E05B 1/00* (2006.01)

(52) U.S. Cl.
CPC ..... *F24C 15/02* (2013.01); *E05B 1/0015* (2013.01); *E05B 7/00* (2013.01); *F24C 15/024* (2013.01); *Y10T 292/57* (2015.04)

(58) Field of Classification Search
CPC ..... F24C 15/02; F24C 15/024; Y10T 292/57; E05B 1/0015; E05B 7/00; A47L 15/42599; E05D 15/04; D06F 39/14; E06B 3/36

(Continued)

(56) References Cited

U.S. PATENT DOCUMENTS 6,467,130 B2 * 10/2002 Karachi ..... B60N 3/023 16/418
7,556,033 B2 * 7/2009 Kim ..... F24C 15/022 126/197

(Continued)

FOREIGN PATENT DOCUMENTS

JP 2005-308277 A 11/2005
KR 10-2004-0059678 A 7/2004

(Continued)

OTHER PUBLICATIONS

International Search Report (PCT/KR2016/012573), WIPO, dated Jan. 26, 2017.

(Continued)

*Primary Examiner* — Christine M Mills
*Assistant Examiner* — Faria F Ahmad
(74) *Attorney, Agent, or Firm* — Park & Associates IP Law, P.C.

(57) ABSTRACT

The present invention relates to a door handle that tilts upward when a door is open initially, and after the tilting has been completed, is slowly returned to an initial state thereof through the resistance of a damper, so that even if a user's fingers are caught in a space between the door handle and the door, the door handle can protect the user's fingers from safety accidents. According to the present invention, the door handle is located on an upper end of a front surface of a door for opening and closing a body so as to open and close a cooking compartment formed inside the body at the time when the door pulls and rotates around door hinges, and the door handle includes a first actuating rod disposed in a vertically erected state on each of both sides of the door and having an end connected to the corresponding door hinge in such a manner as to be movable upward and downward, a second actuating rod disposed above the first actuating rod and coupled to a front end of the first actuating rod by means (Continued)

of a pin, a rotating member having an end coupled to the door handle and a front end coupled to the second actuating rod by means of a pin, and a hinge pin having both ends coupled to a door bracket fixed to the door after passing through the front end of the rotating member, wherein the second actuating rod has an elongated hole formed on a lower end thereof so as to allow the pin for connecting the first actuating rod and the second actuating rod to be fitted thereto in such a manner as to be movable upward and downward.

4 Claims, 7 Drawing Sheets

(58) Field of Classification Search
USPC ..... 312/326
See application file for complete search history.

(56) References Cited

U.S. PATENT DOCUMENTS 8,490,616 B2 * 7/2013 Venezia ..... F24C 15/006 126/190
9,777,523 B2 * 10/2017 Choi ..... D06F 39/14
10,145,163 B2 * 12/2018 Choi ..... D06F 39/14
10,551,070 B2 * 2/2020 Park ..... E05B 53/00
2003/0126718 A1 * 7/2003 Yamamoto ..... B60N 3/023 16/110.1
2005/0023946 A1 * 2/2005 Bartmann ..... F24C 15/023 312/328
2014/0035453 A1 * 2/2014 Kwon ..... F24C 15/024 312/325
2016/0076289 A1 * 3/2016 Choi ..... A47L 15/4259 312/326
2018/0163443 A1 * 6/2018 Park ..... E05C 3/165
2018/0292094 A1 * 10/2018 Park ..... E05B 53/00

FOREIGN PATENT DOCUMENTS

KR 10-2004-0061311 A 7/2004
KR 10-1370923 B1 3/2014
KR 10-1493165 B1 2/2015
KR 10-1535371 B1 7/2015

OTHER PUBLICATIONS

Korean Office Action (KR 10-2015-0173775), KIPO, dated Feb. 22, 2017.
Korean Notice of Allowance (KR 10-2015-0173775), KIPO, dated Jul. 18, 2017.

* cited by examiner

DOOR HANDLE

REFERENCE TO RELATED APPLICATIONS

This is a continuation of International Patent Application PCT/KR2016/012573 filed on Nov. 3, 2016, which designates the United States and claims priority of Korean Patent Application No. 10-2015-0173775 filed on Dec. 8, 2015, the entire contents of which are incorporated herein by reference.

FIELD OF THE INVENTION

The present invention relates to a door handle and, more particularly, to a door handle that tilts upward when a door is initially open, and after the tilting operation has been completed, that is slowly returned to an initial state thereof through the resistance of a damper, so that even if a user's fingers are caught in a space between the door handle and the door, the door handle can protect the user's fingers from safety accidents.

BACKGROUND OF THE INVENTION

Generally, an oven as one of electric home appliances serves to cook an object put in a cooking compartment formed at the inside thereof by means of heat generated from a heater, as a heating source. Of course, the oven may have another heating source, for example, microwaves generated from a magnetron.

In the state where a front surface of the oven is open, on the other hand, it is closed by means of a door, and if it is desired to open the oven, the door is pulled down, that is, moves forward to be open, so that an interior of the oven is open.

A door handle is mounted horizontally on a front surface of the door. One of conventional door handles is disclosed in Korean Patent Application Laid-open No. 10-2004-0061311 (entitled 'door handle for gas oven' and hereinafter, referred to as prior art).

According to the prior art, the door handle includes a handle center part, handle parts as handle side parts coupled to both sides of the handle center part, and handle fixing parts fixed to a door in the state of being coupled to both sides of the handle parts, and the handle side parts have protrusions formed from the inner sides thereof and the handle center part has grooves formed on the outer sides of insertion ends formed on both sides thereof in such a manner as to be coupled to the protrusions.

According to the prior art, if the door handle is held and pulled down to open a cooking compartment of the oven, the door handle itself further moves downward, and since the door handle is fixed to the door, at this time, a rotating angle of the door handle becomes increased according to an opening operation of the door, so that a user's wrist holding the door handle may be bent to undesirably cause many inconveniences in use.

If it is desired that the door is initially open in the state where it is closed, particularly, the user's fingers may be caught in a space between the door and the door handle, and at this time, if the door is open in the state where the user's fingers are caught in the space, safety accidents may happen.

SUMMARY OF THE INVENTION

Accordingly, the present invention has been made in view of the above-mentioned problems occurring in the prior art, and it is an object of the present invention to provide a door handle that is capable of tilting upward at the time when it is held to pull so as to initially open a door, thereby preventing a user's fingers from being caught in a space between the door and the door handle.

It is another object of the present invention to provide a door handle that is capable of being slowly returned to an initial state thereof through resistance of a damper after it has tilted, so that even if a user's fingers are caught in a space between the door handle and a door, the door handle can protect the user's fingers from safety accidents.

To accomplish the above-mentioned objects, according to the present invention, there is provided a door handle located on an upper end of a front surface of a door for opening and closing a body so as to open and close a cooking compartment formed inside the body at the time when the door pulls and rotates around door hinges, the door handle including a first actuating rod disposed in a vertically erected state on each of both sides of the door and having an end connected to the corresponding door hinge in such a manner as to be movable upward and downward, a second actuating rod disposed above the first actuating rod and coupled to a front end of the first actuating rod by means of a pin, a rotating member having an end coupled to the door handle and a front end coupled to the second actuating rod by means of a pin, and a hinge pin having both ends coupled to a door bracket fixed to the door after passing through the front end of the rotating member, wherein the second actuating rod has an elongated hole formed on a lower end thereof so as to allow the pin for connecting the first actuating rod and the second actuating rod to be fitted thereto in such a manner as to be movable upward and downward.

According to the present invention, desirably, a damper is located between the door handle and the rotating member.

According to the present invention, the door handle can tilt upward at the time when it is held to pull so as to initially open a door, thereby preventing a user's fingers from being caught in a space between the door and the door handle, and can be slowly returned to an initial state thereof through resistance of a damper at the time when the tilted door handle is returned to the initial state by means of a tension force of a spring, so that even if a user's fingers are caught in a space between the door handle and a door, the door handle can protect the user's fingers from safety accidents.

EXPLANATIONS ON MAIN REFERENCE NUMERALS IN THE DRAWING

| | |
|---|---|
| 10: body | 20: door |
| 30: door hinge | 40: door handle |
| 50: rotating means | 60: connection member |
| 62: first actuating rod | 64: second actuating rod |
| 66: pin | 68: elongated hole |
| 70: rotating member | 74: pin |
| 76: hinge pin | |

DETAILED DESCRIPTION OF THE INVENTION

According to the present invention, there is provided a door handle located on an upper end of a front surface of a door for opening and closing a body so as to open and close a cooking compartment formed inside the body at the time when the door pulls and rotates around door hinges, the door handle including a first actuating rod disposed in a vertically erected state on each of both sides of the door and having an end connected to the corresponding door hinge in such a manner as to be movable upward and downward, a second actuating rod disposed above the first actuating rod and coupled to a front end of the first actuating rod by means of a pin, a rotating member having an end coupled to the door handle and a front end coupled to the second actuating rod by means of a pin, and a hinge pin having both ends coupled to a door bracket fixed to the door after passing through the front end of the rotating member, wherein the second actuating rod has an elongated hole formed on a lower end thereof so as to allow the pin for connecting the first actuating rod and the second actuating rod to be fitted thereto in such a manner as to be movable upward and downward.

Hereinafter, the present invention will now be described in detail with reference to the attached drawing. Before the present invention is disclosed and described, it is to be understood that the disclosed embodiments are merely exemplary of the invention, which can be embodied in various forms. The present disclosure is to be considered as an exemplification of the principles of the invention and the associated functional specifications for its construction and is not intended to limit the invention to the embodiment illustrated.

Figure 1:
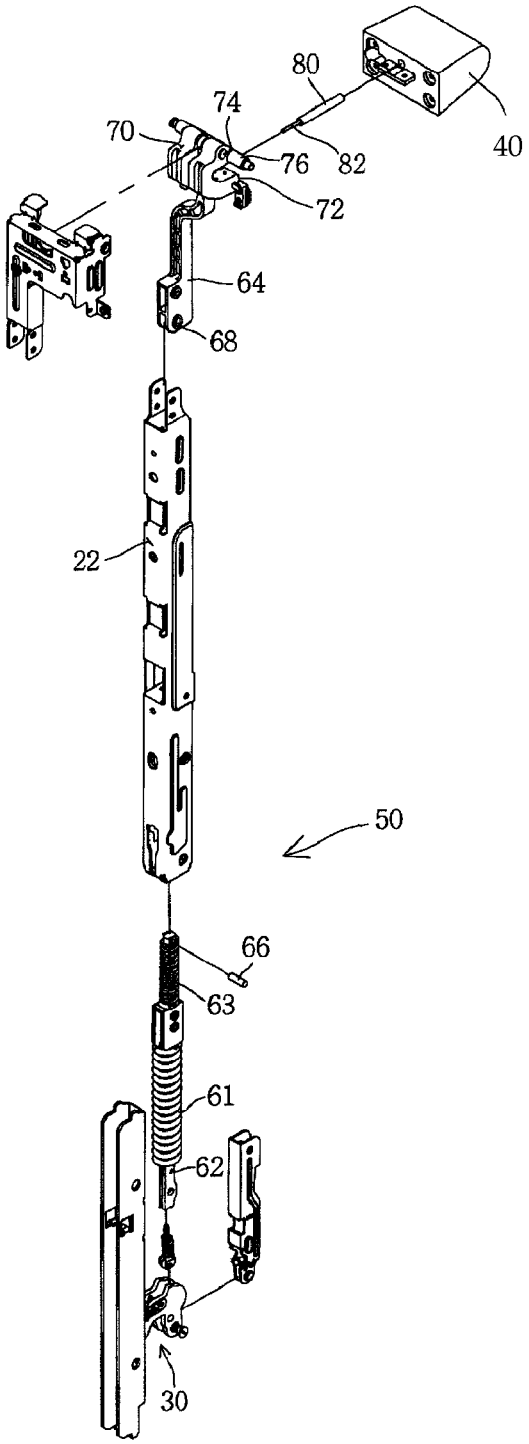
FIG. 1 is an exploded perspective view showing a whole configuration of a door hinge to which a door handle according to the present invention is disposed.
Figure 2:
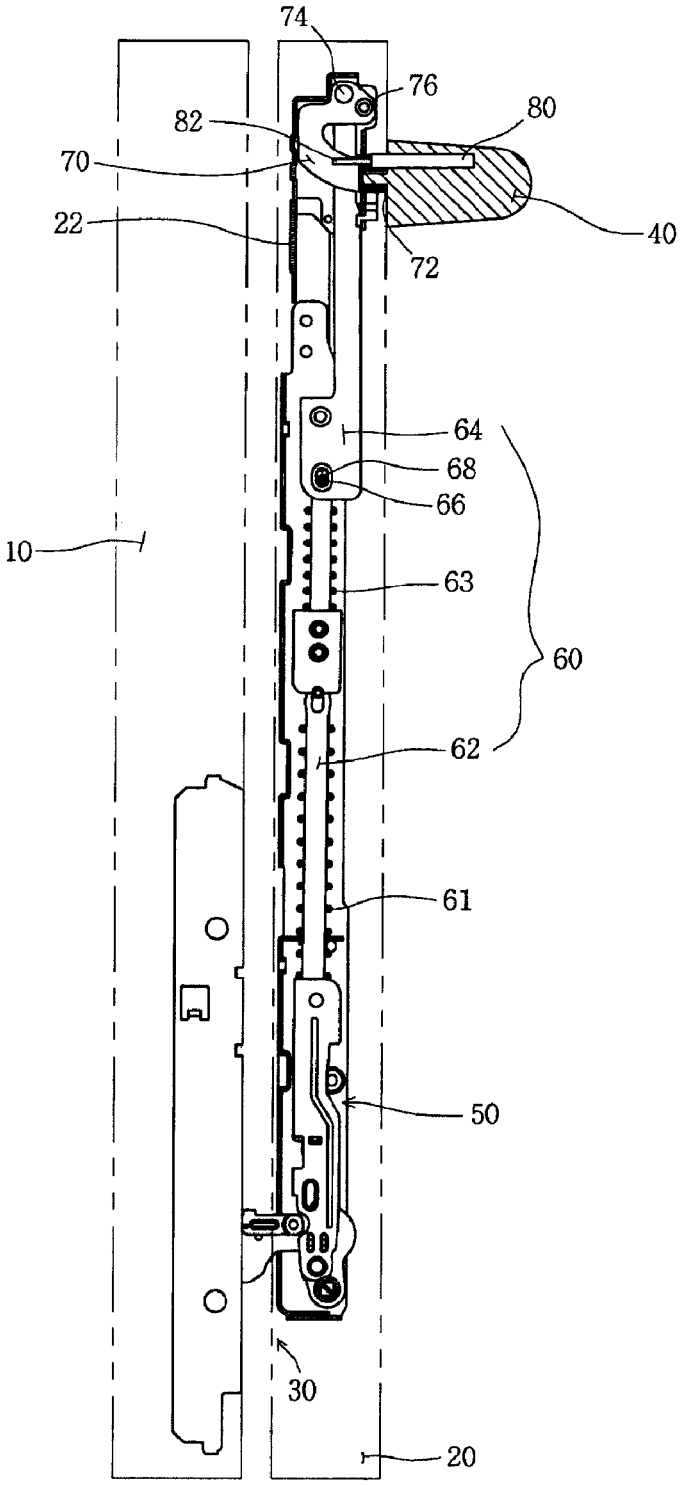
FIG. 2 is a side sectional view of FIG. 1.
Figure 3:
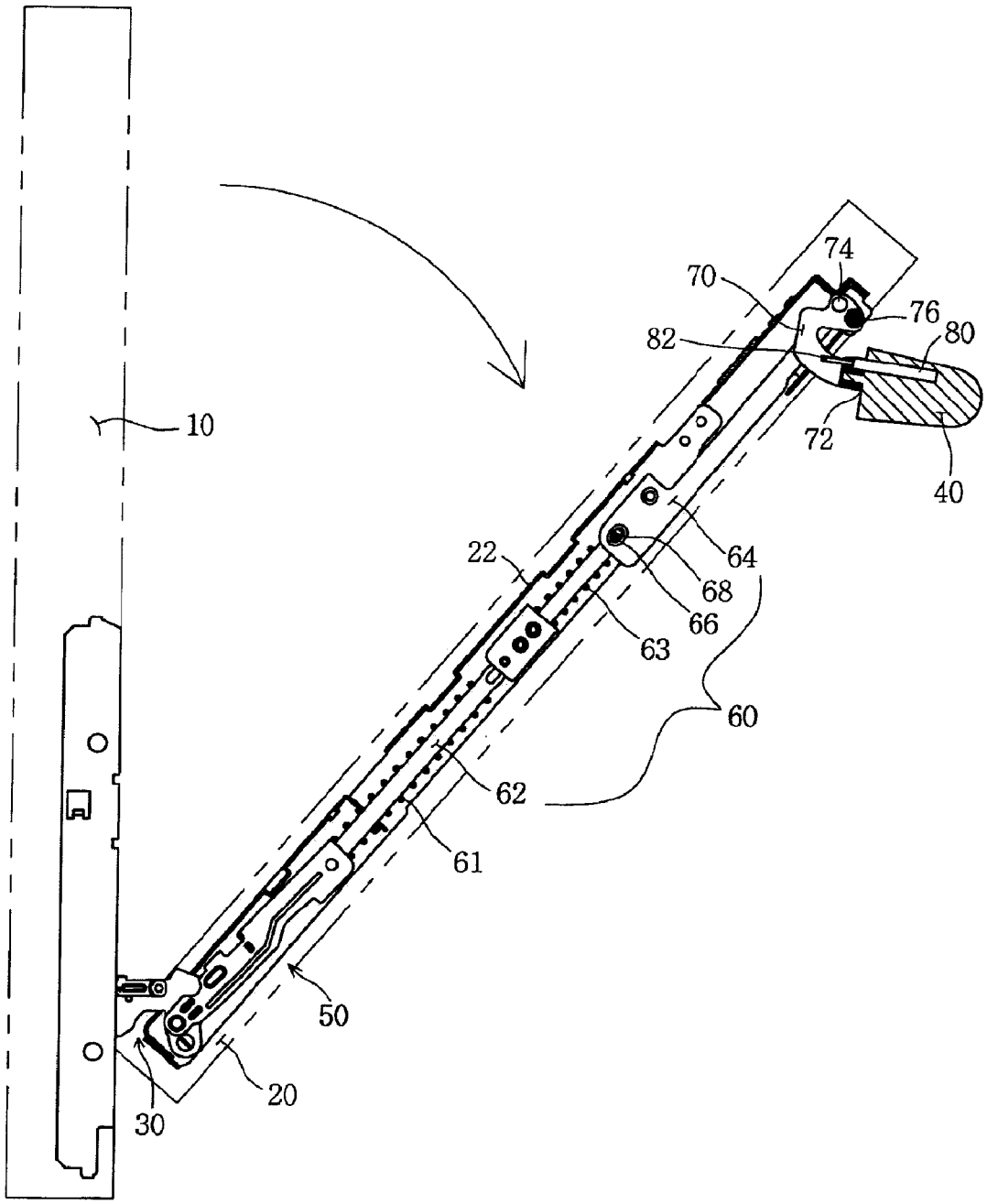
FIG. 3 is a side sectional view showing a rotating operation of the door handle of FIG. 1 according to an opening operation of a door.

FIG. 1 is an exploded perspective view showing a configuration of a door handle according to the present invention, and FIG. 2 is a side sectional view showing the door handle of FIG. 1.

On the other hand, the door handle according to the present invention is disposed on a door that is located on a front surface of an electric home appliance like an oven in such a manner as to pull down, that is, to move forward to be open and closed.

As shown in FIGS. 1 and 2, the oven includes a body 10 having a cooking compartment and a door 20 located on a front surface of the body 10, coupled to the body 10 on both sides of a lower end thereof by means of door hinges 30, and rotating around the door hinges 30 to open and close the cooking compartment of the body 10. In detail, the door 20 is pulled down with respect to the door hinges 30 coupled to the body 10, that is, moves forward so that it is open and closed to allow the cooking compartment of the body 10 to be open and closed.

A door handle 40 is located on an upper end of a front surface of the door 20, and at this time, rotating means 50 are located on both ends of the door handle 40 to allow the door handle 40 to be rotatably connected to the front surface of the door 20. In this case, the rotating means 50 are connected to the door hinges 30 mounted on the door 20 so that when the door hinges 30 rotate upon an opening operation of the door 20, the rotating means 50 serve to allow the door handle 40 to perform a rotating operation so that the door handle 40 is kept in a horizontal state and also to allow the door handle 40 to perform a tilting operation upon initial opening of the door 20.

At this time, the rotating operation of the door handle 40 means that the door handle 40 rotates so that it is always kept in the horizontal state irrespective of an opening angle of the door 20 being open, thereby preventing a user's wrist holding the door handle 40 from being bent inconveniently.

Also, the tilting operation of the door handle 40 means that the door handle 40 rotates at a relatively small angle to prevent the user's fingers from being caught in a space between the door 20 and the door handle 40 at the time when the door 20 is open or closed.

Hereinafter, representatively, one rotating means 50 disposed on one end of the door handle 40 will be explained.

The rotating means 50 includes a connection member 60 and a rotating member 70.

The connection member 60 is connected to a lower end of a door bracket 22 of the door 20 on one end thereof and to the rotating member 70 on the other end thereof, so that when the door 20 performs an opening operation, the connection member 60 moves upward and downward to allow the door handle 40 connected to the rotating member 70 to be always kept in the horizontal state.

The connection member 60 includes a first actuating rod 62 and a second actuating rod 64. An end of the first actuating rod 62 is connected to the door hinge 30 in such a manner as to be movable upward and downward, and a front end thereof is coupled to an end of the second actuating rod 64 by means of a pin 66. The second actuating rod 64 has an elongated hole 68 formed on an end thereof in such a manner as to allow the pin 66 to be movable upward and downward therealong, so that it can be coupled to the first actuating rod 62.

First and second springs 61 and 63 are fitted to the outer peripheral surfaces of the first actuating rod 62 and the second actuating rod 64 to elastically support the forward and downward movements of the first actuating rod 62 and the second actuating rod 64.

The rotating member 70 is located on top of the second actuating rod 64 and has an end 72 passing through the door 20 in such a manner as to be coupled to the door handle 40 and a front end coupled to the second actuating rod 64 by means of a pin 74, thereby allowing the door handle 40 to be connected to the second actuating rod 64.

The rotating member 70 has a hinge pin 76 penetratedly disposed on the front end thereof, and the hinge pin 76 is coupled to the door bracket 22 fixed to the door 20, so that when the door handle 40 pulls forward to open the door 20, the rotating member 70 rotates around the hinge pin 76 to allow the door handle 40 to be always kept in the horizontal state.

In detail, if the door handle 40 pulls forward in the state where it is held by the user's hand to open the cooking compartment of the body 10, the door 20 is inclined forward with respect to the door hinge 30 and is thus open, and at this time, the door handle 40 is automatically kept in the horizontal state and then rotates to move down by means of the rotating member 70, irrespective of the forward inclination of the door 20, thereby preventing the user's wrist holding the door handle 40 from being inconveniently bent.

In more detail, a pulling force is generated from the rotating member 70 according to the downward movement of the connection member 60 in the process where the door 20 is open, and at this time, the rotating member 70, which is coupled to the second actuating rod 64 of the connection member 60 by means of the pin 74, rotates around the hinge pin 76 to allow the door handle 40 to rotate in a counterclockwise direction, which is the opposite direction to the direction of rotating the door 20, so that the door handle 40 can be always kept in the horizontal state, irrespective of the opening operation of the door 20.

Figure 4:
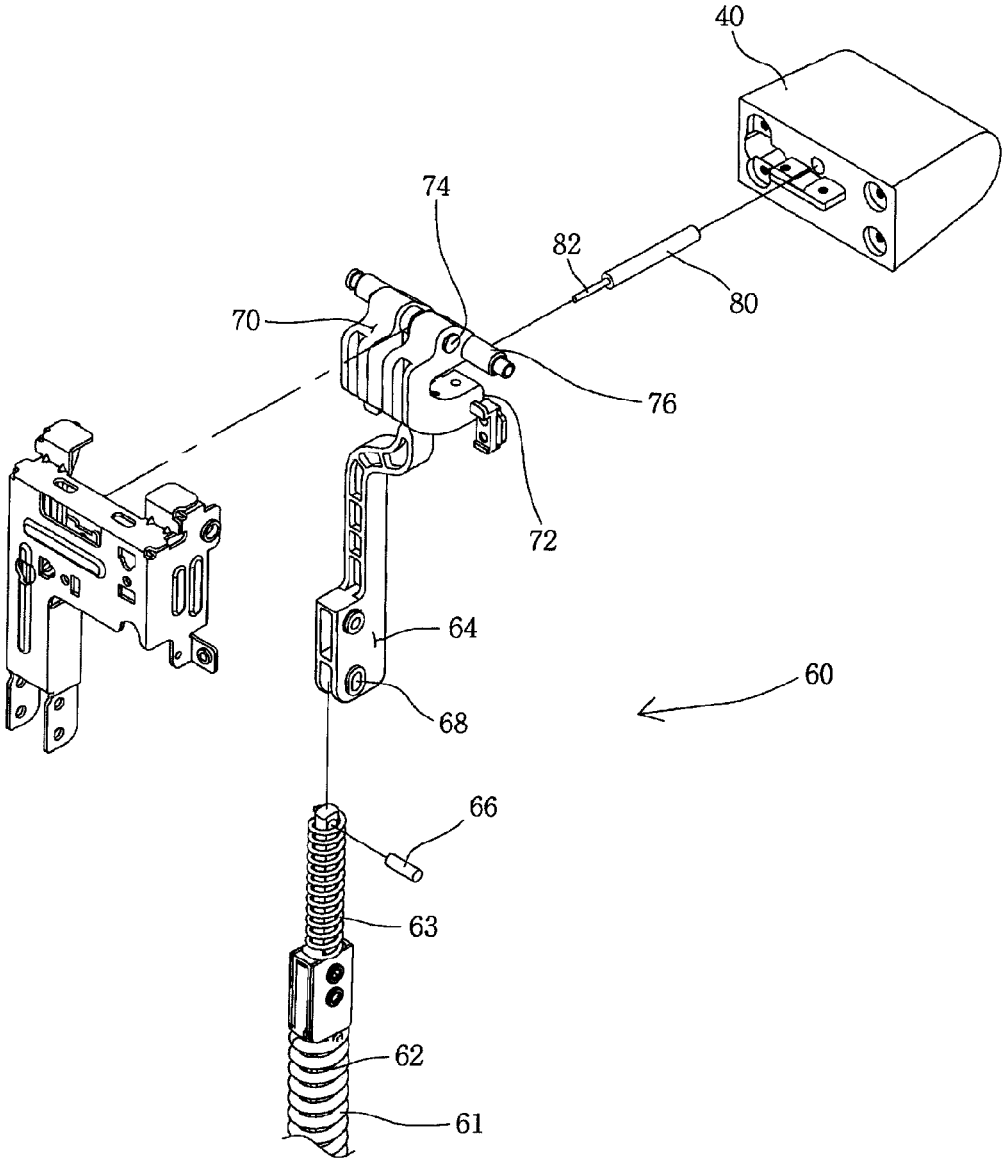
FIG. 4 is an exploded perspective view showing the door handle and a rotating means of FIG. 1.
Figure 5:
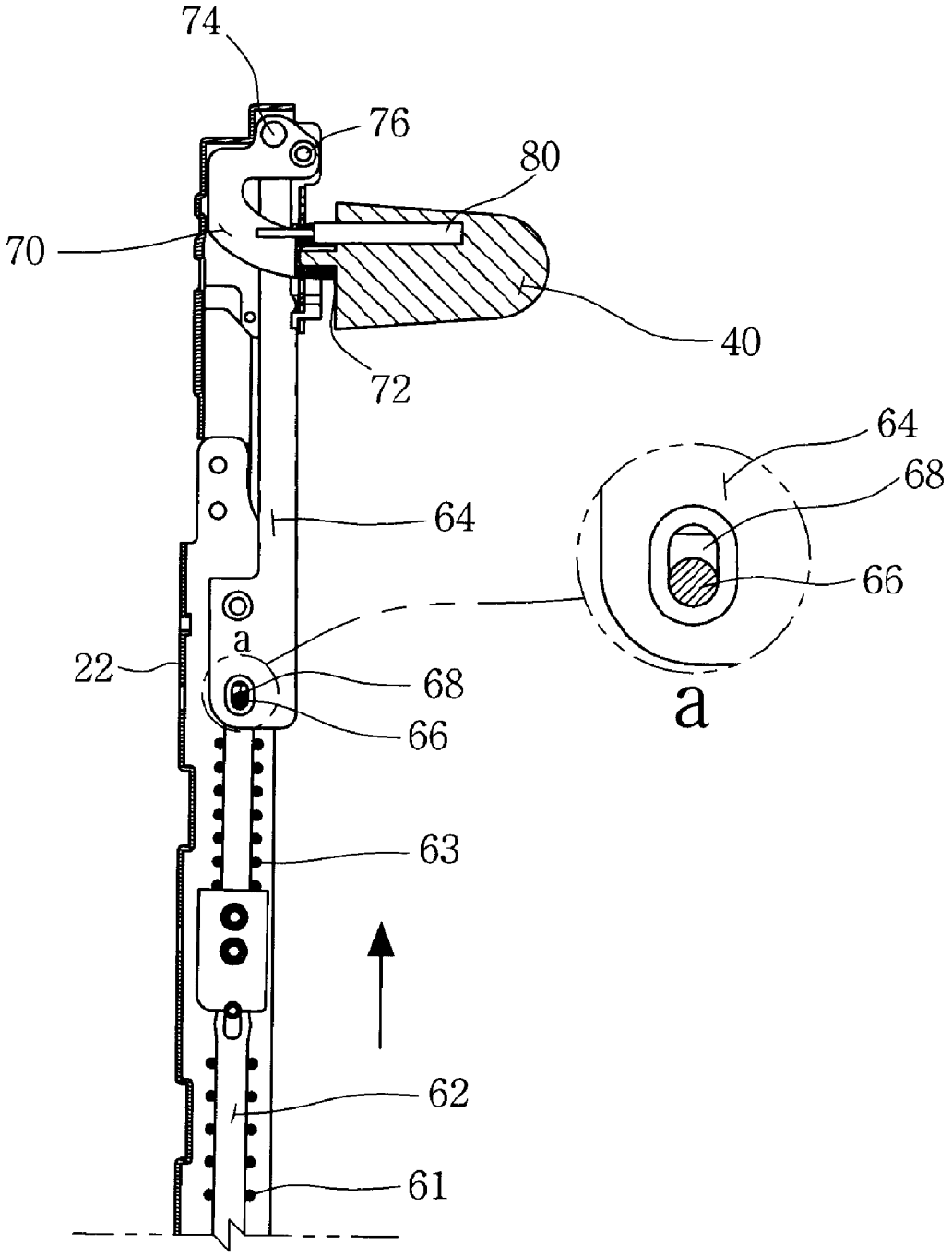
FIG. 5 is a side sectional view of FIG. 4.

In addition to the rotating operation, on the other hand, the rotating member 70 performs the tilting operation so that the door handle 40 rotates to a small angle, thereby preventing the user's fingers from being caught in the space D between the door 20 and the door handle 40 before the door 20 is initially open, and so as to perform the tilting operation, accordingly, the coupling structure between the rotating member 70 and the first and second actuating rods 62 and 64 will be explained with reference to FIGS. 4 and 5.

As shown in FIGS. 4 and 5, as mentioned above, the pin 66 is coupled to the front end of the first actuating rod 62, and the elongated hole 68, to which the pin 66 is fitted, is formed on the end of the second actuating rod 64, so that the first actuating rod 62 and the second actuating rod 64 are coupled to each other.

In this state, the second actuating rod 64 and the rotating member 70 are coupled to each other by means of the pin 72, and such coupling structure is prepared to perform the tilting operation so that the door handle 40 rotates to the small angle (for example, 0 to 18°) when the door handle 40 pulls to initially open the door 20. If the door handle 40 pulls, in detail, the rotating member 70, which is coupled to the door handle 40 by means of the hinge pin 76, rotates around the hinge pin 76, and in this process, the second actuating rod 64 coupled to the rotating member 70 by means of the pin 74 is pressurized, so that only the second actuating rod 64 moves down by means of the pin 66 of the first actuating rod 62 moving down along the elongated hole 68 formed on the end thereof, thereby allowing the door handle 40 to tiltingly rotate.

As the door handle 40 itself tiltingly rotates, the user's fingers are not caught in the space D between the door 20 and the door handle 40 in the process where the door handle 40 is held by the user's hand to open the door 20, thereby avoiding occurrence of safety accidents.

While the door 20 is being open after the door handle 40 tiltingly rotates, the door handle 40 is returned to its initial state by means of a tension force of the second spring 63 fitted to the second actuating rod 64.

Figure 7:
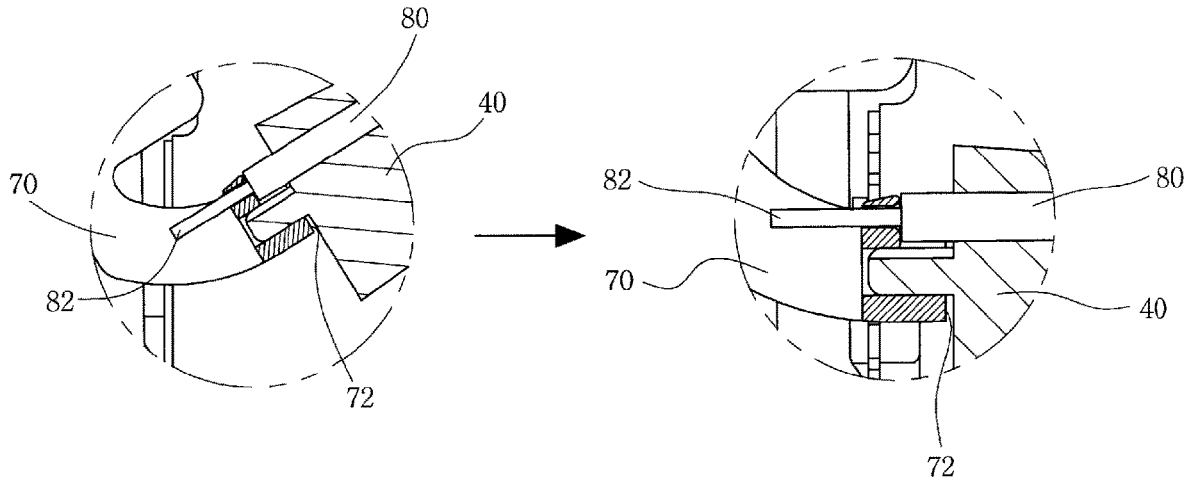
FIG. 7 is a side sectional view showing a returning state of the door handle according to the present invention to an initial state.

On the other hand, a damper 80 is located on an upper end of the door handle 40, and the damper 80 has a rod 82 connected to the rotating member 70. When the door handle 40 is returned to its initial state by means of the tension force of the second spring 63 after the door handle 40 tilts and an external force applied to the door handle 40 is then removed, as shown in FIG. 7, the damper 80 serves as a resistance means so that the door handle 40 is not rapidly returned to its initial state.

If the door handle 40 is rapidly returned to its initial, in detail, the user's fingers may be caught in the space D between the door 20 and the door handle 40, but through the formation of the damper 70, the door handle 40 is slowly returned to its initial state, thereby preventing the occurrence of such safety accidents.

Hereinafter, an explanation on an operation of the door handle according to the present invention will be given with reference to FIGS. 1 to 7.

First, the door handle 40 located on the front surface of the door 20 is held by the user's hand and is then pulled forward so as to open the cooking compartment of the body 10, and at this time, the door handle 40 primarily tilts upward so that the user's fingers are not caught in the space D between the door 20 and the door handle 40. After that, the door handle 40 rotates according to the opening operation of the door 20.

Figure 6:
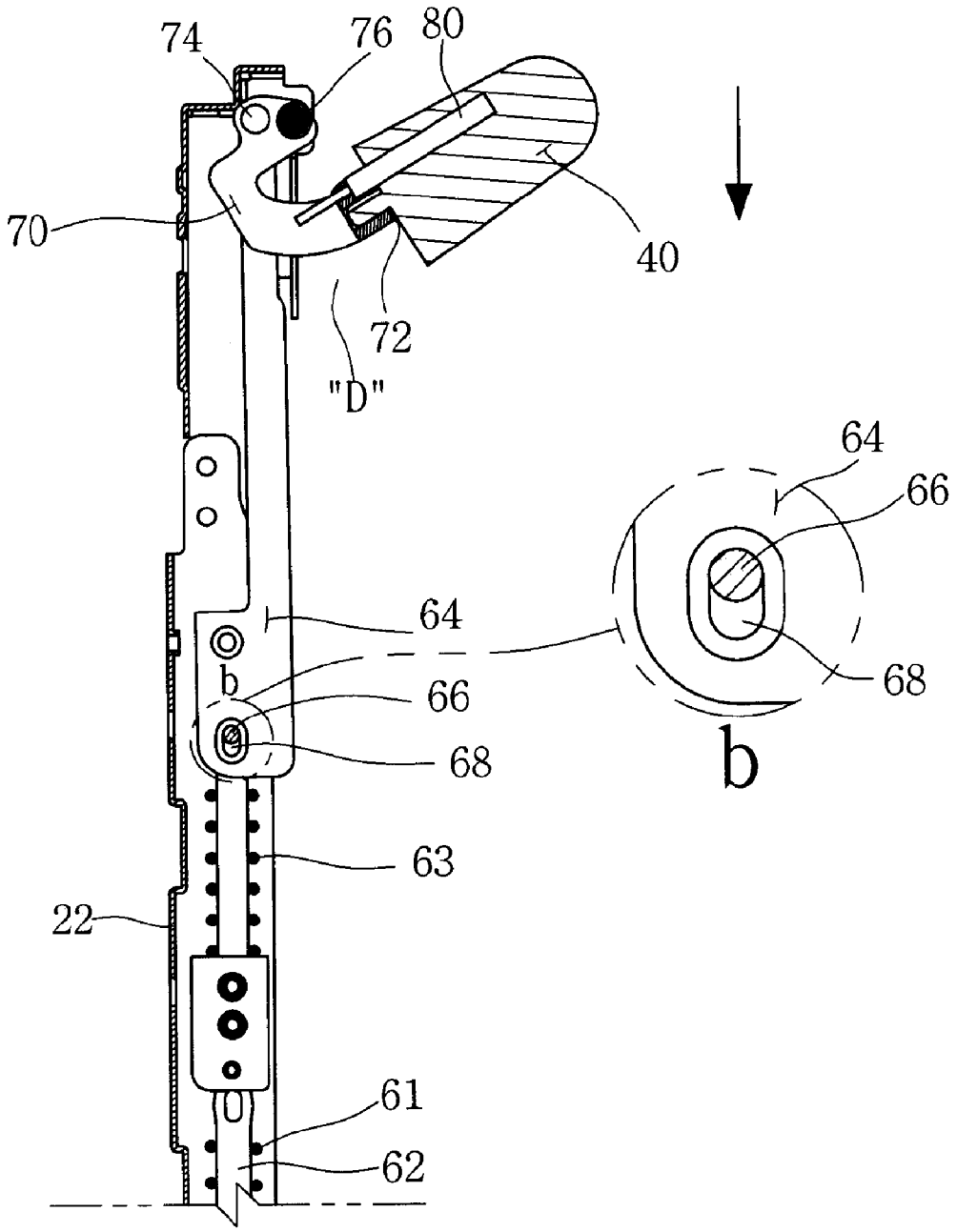
FIG. 6 is a side sectional view showing a state of a tilting operation of the door handle according to the present invention.

If the door handle 40 is held to pull, in detail, the rotating member 70 coupled to the door handle 40 by means of the hinge pin 76 rotates around the hinge pin 76, as shown in FIG. 6, and in this process, the rotating member 70 pressurizes the second actuating rod 64 coupled thereto by means of the pin 74, so that only the second actuating rod 64 moves down by means of the pin 66 of the first actuating rod 62 moving down along the elongated hole 68 formed on the end thereof, thereby allowing the door handle 40 to tiltingly rotate.

If the door 20 is open, the door handle 40 is returned to its initial state by means of the tension force of the second spring 63 fitted to the second actuating rod 64, and at this time, the door handle 40 can be slowly returned to its initial state by means of the impact releasing effect of the damper 80 located between the door handle 40 and the rotating member 70, thereby preventing the user's fingers from being caught in the space D between the door handle 40 and the door 20.

While the door 20 is being open, on the other hand, the door handle 40 performs the rotating operation so that it can be always kept in the horizontal state. In the process where the door 20 is open, that is, a pulling force is generated from the rotating member 70 according to the downward movement of the connection member 60, and at this time, the rotating member 70, which is coupled to the second actuating rod 64 of the connection member 60 by means of the pin 74, rotates around the hinge pin 76 to allow the door handle 40 to rotate in a counterclockwise direction, which is the opposite direction to the direction of rotating the door 20, so that the door handle 40 can be always kept in the horizontal state, irrespective of the opening operation of the door 20, thereby preventing the user's wrist holding the door handle 40 from being inconveniently bent in the process where the door 20 is open.

What is claimed is:

1. A handle system provided at a door (20) for opening and closing the door with respect to a body (10) coupled to the door, the handle system comprising:

a door handle (40);

a door bracket (22) coupled to the door (20);

a first actuating rod (62) disposed at a lower side of the door bracket (22), the first actuating rod (62) including a lower end connected to a door hinge (30) and an upper end with a connecting pin (66) installed thereto;

a second actuating rod (64) disposed above the first actuating rod (62) and coupled to the upper end of the first actuating rod (62) by means of the connecting pin (66) of the first actuating rod (62); and a rotating member (70) disposed at an upper side of the door bracket (22) and having a first end coupled to the door handle (40) and a second end coupled to the second actuating rod (64) by means of a pivot pin (74); and wherein the rotating member includes a hinge pin (76) having two opposite ends coupled to the door bracket (22) and an intermediate portion coupled to the rotating member (70) at a location adjacent to the second end of the rotating member (70), such that, when the door handle (40) is pulled to open the door (20), the rotating member (70) rotates around the hinge pin (76) to allow a tilting operation of the door handle (40) in an upward direction, wherein the second actuating rod (64) has a vertically elongated hole (68) formed on a lower end thereof, the elongated hole (68) allowing the connecting pin (66) of the first actuating rod (62) to be vertically slidably fitted thereto, wherein the first actuating rod (62) and the second actuating rod (64) have a spring (63) configured to elastically bias the second actuating rod (64) upwardly so as to apply an upward elastic bias force to the rotating member (70) and the door handle (40), wherein, when the door handle (40) is pulled to open the door at an initial opening stage of the door, the rotation of the rotating member (70) around the hinge pin (76) causes the second actuating rod (64) to move downwardly to a certain length with the elastic bias of the spring (63) applied to the second actuating rod (64), which in turn allows the door handle (40) to be tilted upwardly to a predetermined angle owing to the vertically elongated hole (68) on the lower end of the second actuating rod (64) to which hole the connecting pin (66) is slidably fitted, so as to prevent a user's fingers from being caught in a space between the door and the door handle (40) at the initial opening stage of the door.

2. The handle system according to claim 1, further comprising a damper (80) located between the door handle (40) and the rotating member (70) to control a closing speed of the door handle (40) so as not to move rapidly.

3. The handle system according to claim 2, wherein the damper (80) includes a main body installed at the door handle (40) and a damper rod (82) installed at the rotating member (70).

4. The handle system according to claim 2, wherein the door handle (40) is allowed to be tilted upwardly up to 18 degree at the initial opening stage of the door in order to prevent the user's fingers from being caught in the space between the door and the door handle (40) at the initial opening stage of the door.

* * * * *